United States Patent [19]

Sugerman

[11] Patent Number: 5,050,404

[45] Date of Patent: Sep. 24, 1991

[54] FRAME ASSEMBLY FOR EARRINGS

[76] Inventor: Nathaniel H. Sugerman, 93 Bluff Ave., Cranston, R.I. 02905

[21] Appl. No.: 600,573

[22] Filed: Oct. 19, 1990

[51] Int. Cl.[5] ..... A44C 7/00

[52] U.S. Cl. ..... 63/13; 211/13

[58] Field of Search ..... 63/30, 28, 1.1, 2, 29.1, 63/12, 13; 211/13

[56] References Cited

U.S. PATENT DOCUMENTS

| | | | |
|---|---|---|---|
| 3,138,259 | 6/1964 | Sitt | 211/13 |
| 3,339,745 | 9/1967 | Sugerman | 211/13 |
| 3,718,260 | 2/1973 | Sharp | 211/13 |
| 4,966,287 | 10/1990 | Snyder | 211/13 |

*Primary Examiner*—Laurie K. Cranmer

*Attorney, Agent, or Firm*—Salter & Michaelson

[57] ABSTRACT

A frame assembly for pierced earrings includes a frame member which includes a leg portion comprising at least one elongated narrow leg member and a hanger portion for alternatively suspending the leg portion from a plating rack or a display rack. The leg portion has at least one pair of spaced, reduced apertures therethrough and the frame assembly further includes at least one pair of pierced earrings which are assembled with the leg portion so that the posts thereof are received in the apertures therein. The hanger portion of the frame member preferably also has a reduced aperture therethrough for receiving the post of an additional earring in order to suspend the frame assembly from an earlobe of a wearer.

1 Claim, 1 Drawing Sheet

FRAME ASSEMBLY FOR EARRINGS

BACKGROUND AND SUMMARY OF THE INVENTION

The instant invention relates to ornamental jewelry, and more particularly to a rack assembly which is adapted to be used in plating and/or displaying pierced earrings and which is also adapted to be alternatively worn as a composite earring assembly.

It has been found that the assembly and disassembly steps associated with plating ornamental jewelry items and then packaging them for retail display often add considerably to the overall manufacturing costs of such items. In this regard, the procedures heretofore utilized for manufacturing pierced earrings have often included the steps of assembling a plurality of earrings on a relatively large plating rack, plating the earrings in an electroplating solution, disassembling the earrings from the plating rack and then assembling the earrings on display cards. Because the steps of assembling earrings on a plating rack, disassembling them from a plating rack and then assembling them on display cards are both time consuming and tedious, these steps have been found to add significantly to the overall costs of manufacturing pierced earrings.

The instant invention provides an effective frame assembly which is operable for eliminating several of the steps included in the heretofore known procedures for electroplating and packaging pierced earrings. More specifically, the instant invention provides a frame member which can be effectively assembled with one or more pairs of pierced earrings for supporting the earrings during an electroplating process and for thereafter displaying the earrings in a retail display. Still more specifically, the instant invention provides a frame assembly for supporting and displaying pierced earrings comprising a frame member which includes a leg portion comprising at least one elongated narrow leg member, and a hanger member for suspending the frame member from a plating frame. The frame member and the hanger member are preferably made from an electrically conductive material, such as a suitable metal, to enable the frame member to be utilized for supporting earrings during an electroplating process. The leg portion has at least one pair of spaced apertures formed therein and it preferably comprises a pair of elongated narrow leg members which are disposed in spaced, substantially parallel relation and at least one of the apertures is preferably located in each of the leg members. The frame member preferably further includes upper and lower connecting members extending between the upper and lower ends of the leg members, respectively, and each of the leg members preferably has a plurality of spaced apertures therein. The frame assembly further comprises at least one pair of pierced earrings which is assembled so that the posts thereof are received in the apertures in the leg members for releasably securing the earrings on the frame member. The frame assembly preferably further comprises a plurality of pairs of earrings assembled on the leg members so that they are positioned in spaced relation in a substantially uniform array. The frame member is preferably integrally formed from a metal wire and the hanger element is preferably also formed from a metal wire so that it defines a hanging loop and the hanger element preferably has a reduced aperture therethrough for receiving an earring post in order to alternatively suspend the entire frame assembly from an earlobe of a wearer.

It has been found that the frame assembly of the instant invention can be effectively utilized for supporting a pair or a plurality of pairs of earrings during a plating process and for thereafter supporting the earrings in an attractive manner in a retail display. Specifically, it has been found that the frame member of the frame assembly can be effectively utilized for supporting a plurality of pairs of earrings on a plating rack during a plating process and that the frame member can also be utilized as an effective means for supporting a pair or plurality of pairs of earrings on a display rack in a retail display. Still further, the frame member provides a convenient and effective means of packaging a pair or a plurality of pairs of earrings in a group so that they can be effectively displayed and marketed as a composite unit. Even still further, the frame assembly of the instant invention is preferably adapted so that the entire assembly comprising the frame member and one or more pairs of earrings can be suspended from an earlobe of a wearer so that the entire assembly can be worn as a composite unit.

Accordingly, it is a primary object of the instant invention to provide a frame assembly for use in plating and displaying pierced earrings.

Another object of the instant invention is to provide a frame assembly which can be utilized for reducing the labor costs associated with plating and packaging pierced earrings.

An even still further object of the instant invention is to provide a frame assembly comprising a frame member and one or more pairs of pierced earrings wherein the frame member can be utilized for supporting the earrings during a plating process and for thereafter supporting the earrings in a display rack in a retail display.

An even still further object of the instant invention is to provide a frame assembly comprising one or more pairs of pierced earrings which can be suspended as a composite unit from an earlobe of a wearer.

Other objects, features and advantages of the invention shall become apparent as the description thereof proceeds when considered in connection with the accompanying illustrative drawings.

DESCRIPTION OF THE DRAWING:

In the drawing which illustrates the best mode presently contemplated for carrying out the present invention.

DESCRIPTION OF THE INVENTION

Figure 1:
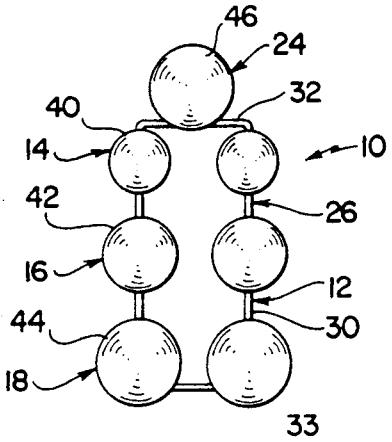
FIG. 1 is a front elevational view of a first embodiment of the frame assembly of the instant invention in combination with a supporting earring.
Figure 2:
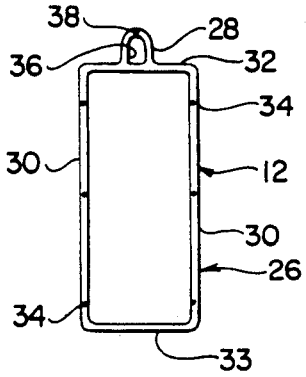
FIG. 2 is a front elevational view of the frame member thereof.
Figure 3:
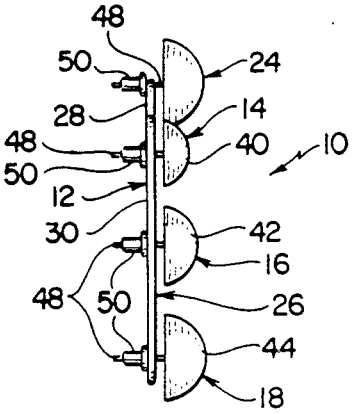
FIG. 3 is a side elevational view of the frame assembly in combination with a supporting earring.

Referring now to the drawing, a first embodiment of the frame assembly of the instant invention is illustrated and generally indicated at 10 in FIGS. 1 and 3 through 6. The frame assembly 10 comprises a frame member generally indicated at 12 in FIGS. 1 through 6, and first, second and third pairs of pierced earrings 14, 16, and 18, respectively. The frame assembly 10 is adapted to be suspended from a plating frame generally indicated at 20 in the manner illustrated in FIG. 4, or from a display rack 22 in the manner illustrated in FIG. 5. Alternatively, the frame assembly 10 is adapted to be utilized in combination with a supporting earring generally indicated at 24 in FIGS. 1, 3 and 6 for suspending the frame assembly 10 from an earlobe of a wearer in the manner illustrated in FIG. 6.

The frame member 12 is preferably made from an electrically conductive material, such as a substantially rigid brass wire or from a metallic stamping or casting, so that it can be effectively utilized for supporting the earrings 14, 16 and 18 during a plating process. Alternatively, the frame member 12 can be made of a nonconductive material, such as a suitable plastic, although in such a case while the frame member 12 can be utilized for suspending the earrings 14, 16, and 18 from a display rack or from an earlobe of a wearer it cannot be utilized during a plating process. In any event, as herein embodied, the frame member 12 is made from a suitable metal wire and it is preferably secured in assembled relation, such as by soldering. The frame member 12 includes a leg portion generally indicated at 26 and a hanger portion generally indicated at 28. The leg portion 26 includes a pair of spaced, substantially parallel, elongated, narrow legs 30, and a pair of upper and lower connecting members 32 and 34, respectively, which extend between the upper and lower ends of the legs 30, respectively, so that they cooperate therewith to define a substantially rectangular structure. The legs 30 each have a plurality of spaced, reduced apertures 34 therein which are preferably disposed in a substantially uniform array, as illustrated. The hanger member 28 is configured to form a hanging loop defining a hanging eye 36. The hanger member 28 is preferably integrally connected to the leg portion 26 and a reduced aperture 38 is formed in the hanger member 28 adjacent the upper extremity thereof.

The earrings 14, 16, 18 and 24 are of generally conventional construction and they include ornament portions 40, 42, 44 and 46, respectively. Each of the earrings 14, 16, 18 and 24 further includes an elongated narrow post 48 of conventional construction and a clutch 50 which is releasably received on the post 48 thereof. The earrings 14, 16 and 18 are assembled on the legs 30 so that the posts 48 thereof extend through the apertures 34, and the clutches 50 are assembled on the posts 48 of the earrings 14, 16 and 18 on the rear side of the frame member 12. When the frame assembly 10 is utilized in combination with the earring 24 in the manner illustrated in FIGS. 1, 3 and 5, the earring 24 is assembled with the frame member 12 so that the post 48 of the earring 24 passes through the aperture 38, and the clutch 50 of the earring member 24 is assembled with the post 48 thereof on the rear side of the frame assembly 10 in the manner illustrated in FIG. 3.

Figure 4:
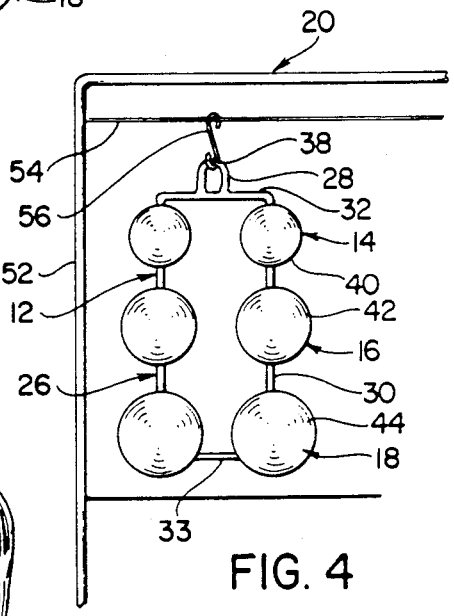
FIG. 4 is a front elevational view of the frame assembly in combination with a plating frame.
Figure 5:
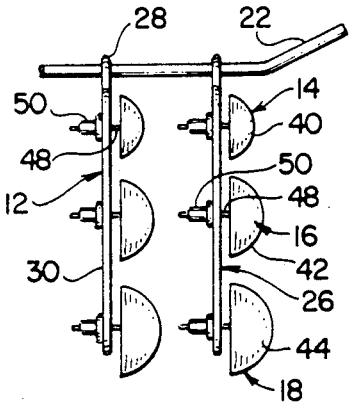
FIG. 5 is a side elevational view of a plurality of the frame assemblies assembled on a display rack
Figure 6:
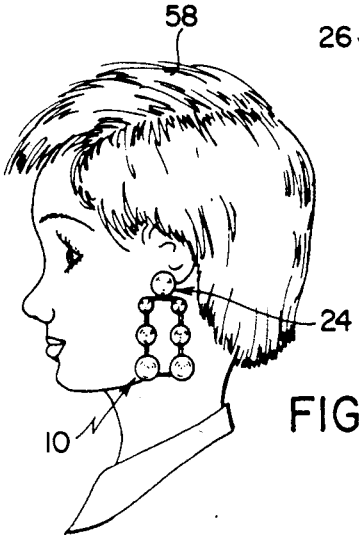
FIG. 6 is a side elevational view of the frame assembly in combination with a supporting earring as worn on an earlobe of a wearer.

Referring now to FIGS. 4 through 6, the use and operation of the frame assembly 10 is illustrated. As illustrated in FIG. 4, the frame assembly 10 can be effectively assembled on a plating rack 20 for supporting the earrings 14, 16 and 18 during a plating operation. The plating rack 20 is of conventional construction and it includes a metal outer frame structure 52 and a metal cross member 54. The frame assembly 10 is adapted to be supported from the cross member 54 by means of a metal hook 56 so that the frame assembly 10, including the frame member 12 and the earrings 14, 16 and 18, are all in electrical contact with the plating rack 20. The plating rack 20 is of conventional construction and it is adapted to be immersed in an electroplating bath containing a plating solution for electroplating the earrings 14, 16 and 18, and the frame member 12 in a conventional manner. Once the frame assembly 10 has been plated in this manner the frame assembly 10 can be removed from the plating rack 20; and since the frame assembly 10 defines a composite unit of several pairs of earrings which are effectively and attractively supported in spaced relation, the frame assembly 10 can thereafter be utilized for packaging and displaying the earrings 14, 16 and 18 in the manner illustrated in FIG. 5. Specifically, one or more frame assemblies 10 can be effectively supported on a conventional display rack 52 in order to display the earrings 14, 16 and 18 in preassembled composite units in the frame assemblies 10.

While the frame assembly 10 provides a convenient and effective composite structure which substantially reduces the material handling costs associated with plating and packaging the earrings 14, 16 and 18, it also provides an alternative earring structure as illustrated in FIG. 6. Specifically, an entire frame assembly 10 can be assembled with a supporting earring 24 to suspend the frame assembly 10 from an earlobe of a wearer 58. Alternatively, the earrings 14, 16 and 18 can be worn in pairs in a more conventional manner by disassembling them from the leg portion 26 and assembling them on the earlobes of the wearer 58.

Figure 7:
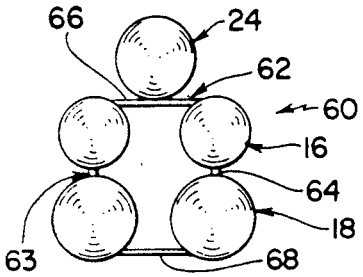
FIG. 7 is a front elevational view of a second embodiment of a frame assembly in combination with a supporting earring.

Referring now to FIG. 7, a second embodiment of the frame assembly of the instant invention is illustrated and generally indicated at 60. The frame assembly 60 is illustrated in combination with a supporting earring 24, and it comprises a frame member generally indicated at 62 which is preferably made from a suitable wire, such as brass wire, although here again the frame member could be a metallic stamping or casting. The frame member 62 includes a leg portion 63, including a pair of spaced, substantially parallel, elongated legs 64, and upper and lower connecting members 66 and 68 which extend between the upper and lower ends of the legs 64. The frame member 62 further comprises a hanger member (not shown), which is substantially the same as the hanger member 28, the hanger member 28 having a reduced aperture (not shown) therethrough which is similar to the aperture 38. The leg members 64 also have reduced apertures (not shown) therethrough which are similar to the apertures 34 and the frame assembly 60 also includes a plurality of pairs of earrings 16 and 18 which are assembled in the apertures in the leg members 64.

The frame assembly 60 is adapted to be utilized in the manner hereinabove described with respect to the frame assembly 10. Specifically, the frame assembly 60 can be effectively suspended from a plating rack 20, or from a display rack 22 in the manner illustrated in FIGS. 4 and 5, respectively. Alternatively, the frame assembly 60 can be assembled with the earring 24 in order to suspend the frame assembly 16 from an earlobe of a wearer in a manner similar to that illustrated in FIG. 6.

Figure 8:
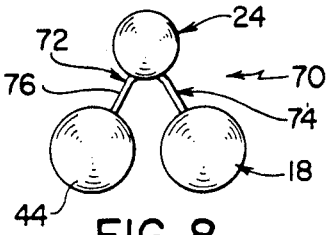
FIG. 8 is a front elevational view of a third embodiment of the frame assembly in combination with a supporting earring.

Referring now to FIG. 8, a third embodiment of the frame assembly of the instant invention is illustrated and generally indicated at 70. The frame assembly 70 is illustrated in combination with a supporting earring 24 and it includes a frame member 72 including a leg portion 74 comprising a pair of legs 76. The frame member 72 further comprises a hanger member (not shown), which is generally similar to the hanger member 28, and which has an aperture similar to the aperture 38 therethrough. The legs 76 also have reduced apertures (not shown) therethrough and the frame assembly 70 further comprises a pair of earrings 18 which are assembled in the apertures in the legs 76.

Accordingly, the frame assembly 70 can be alternatively suspended from a plating rack 20 in the manner illustrated in FIG. 4, or from a display rack 22. The frame assembly 70 can also be worn in combination with the earring 24 for suspending the frame assembly 70 from an earlobe of a wearer.

It is seen therefore that the instant invention provides an effective frame assembly for earrings. The frame assemblies 10, 60 and 70 can be effectively utilized for both plating and displaying pierced earrings in the manner illustrated. As a result, the frame assemblies 10, 60 and 70 effectively eliminate a significant portion of the material handling costs normally associated with plating and displaying pierced earrings. The frame assemblies 10, 60 and 70 can also be effectively worn as composite assemblies on the earlobes of wearers. Hence, it is seen that the frame assemblies of the instant invention represent significant advancements in the jewelry art which have substantial commercial merit.

As will be noted, the frame assemblies 10, 60, and 70 are generally rectangular, square, and triangular, respectively. Obviously other shapes could be used, such as circular, heart shaped, diamond shaped, etc.

While there is shown and described herein certain specific structure embodying the invention, it will be manifest to those skilled in the art that: various modifications and rearrangements of the parts may be made without departing from the spirit and scope of the underlying inventive concept and that the same is not limited to the particular forms herein shown and described except insofar as indicated by the scope of the appended claims.

What is claimed:

1. A frame assembly for pierced earrings comprising:

a. a frame member including a leg portion comprising at least one elongated narrow leg member, said leg portion having a pair of reduced spaced apertures therein, and means for suspending said leg portion from a plating frame;

b. a pair of pierced earrings, each of said earrings including a post and a clutch received on the post thereof and each being assembled on said leg portion so that the post thereof is received in a different one of said apertures; and c. said suspending means including a hanger member integrally formed with said frame member, said hanger member being defined by a hanger element which is formed to define a hanging loop, said hanger element having a reduced aperture therethrough, said frame assembly further comprising a supporting pierced earring, the post of said supporting pierced earring being received in the reduced aperture in said hanger element and being operative for alternatively suspending said frame assembly from an ear lobe of a wearer.

* * * * *